US005119532A

United States Patent [19]

Tanaka

[11] Patent Number: 5,119,532

[45] Date of Patent: Jun. 9, 1992

[54] BUCKLE APPARATUS

[75] Inventor: Kohbun Tanaka, Aichi, Japan

[73] Assignee: Kabushiki Kaisha Toka-Rida-Denki-Seisakusho, Japan

[21] Appl. No.: 671,118

[22] Filed: Mar. 18, 1991

[30] Foreign Application Priority Data

Mar. 30, 1990 [JP] Japan ..... 2-33910[U]

[51] Int. Cl.[5] ..... A44B 11/26

[52] U.S. Cl. ..... 24/641; 24/645; 24/639

[58] Field of Search ..... 24/633, 639-642, 24/645; 297/468

[56] References Cited

U.S. PATENT DOCUMENTS 4,562,625 1/1986 Dotz et al. ..... 24/640
4,624,034 11/1986 Ishiguro et al. ..... 24/636 X
4,670,952 6/1987 Ishiguro et al. ..... 24/639 X
4,928,366 5/1990 Ballet ..... 24/641

FOREIGN PATENT DOCUMENTS 61-55813 4/1986 Japan .
61-118406 7/1986 Japan .
WO88/06013 8/1988 PCT Int'l Appl. ..... 24/633

*Primary Examiner*—James R. Brittain
*Attorney, Agent, or Firm*—Sixbey, Friedman, Leedom & Ferguson

[57] ABSTRACT

A buckle apparatus comprises a buckle body into which a tongue plate is inserted, and a lock plate with which the tongue plate is engaged and locked. The buckle body is provided with an opening through which a portion of the lock plate is passed in a condition of the tongue plate locked to the lock plate, so that when a load larger than a predetermined value is applied in a direction of withdrawal of the tongue plate in such locked condition, at least a portion of the lock plate is moved in the tongue plate withdrawal direction. Such portion of the lock plate is provided with a projection which is adapted to be brought into engagement with an edge of the opening by the movement of such portion, thereby inhibiting the movement of the lock plate in a direction to release the tongue plate-locked condition. Therefore, even if a load larger than a predetermined value is applied to the tongue plate in the locked condition, the tongue plate cannot be disengaged from the buckle apparatus.

18 Claims, 16 Drawing Sheets

BUCKLE APPARATUS

BACKGROUND OF THE INVENTION

1. Field of the Invention

The present invention relates to a buckle apparatus for use in a seat belt for protecting an occupant in case of emergency.

2. Description of the Prior Art

In general, a buckle apparatus for use in a seat belt system is designed so that an occupant can wear an occupant arresting webbing by engagement of a tongue plate mounted at an end or an intermediate portion of the webbing with the buckle apparatus.

Some of the conventional buckle apparatuses are of a construction such that a higher load applied to a tongue plate supported in abutment on a buckle body can be reliably supported by a lock plate on opposite sides of its engaging portion with the tongue plate (see Japanese Utility Model Application Laid-open Nos. 61-55813 and 61-118406).

In the buckle apparatus of such a structure, however, if the direction of a load applied from the tongue plate to the lock plate is offset, i.e., if the direction of insertion and withdrawal of the tongue plate is offset to permit the application of a tensioning force, a component of the load is applied to the lock plate in a direction to displace the lock plate.

For this reason, the lock plate and relevant components must be fabricated firmly.

SUMMARY OF THE INVENTION

Accordingly, it is an object of the present invention to provide a buckle apparatus of a type in which the lock plate supports the tongue plate on its opposite sides, wherein the lock plate is retained despite an offset load.

To achieve the above object, according to the present invention, there is provided a buckle apparatus for locking a tongue plate inserted therein, comprising a buckle body into which the tongue plate is inserted, a lock plate disposed in the buckle body and adapted to be engaged by the inserted tongue plate, so that when a load larger than a predetermined value is applied to the tongue plate in the direction of withdrawal of the tongue plate in a condition of the tongue plate in engagement with the lock plate, at least a portion of the lock plate is moved in a direction of withdrawal of the tongue plate, and an engagement means provided between the buckle body and the lock plate and adapted to be brought into an engaged state by the movement of at least a portion of the lock plate, thereby inhibiting the movement of the lock plate in a direction of separation from the tongue plate.

With the buckle apparatus of the above construction, if the tongue plate is inserted into the buckle body, it is brought into engagement with the lock plate, so that the movement of the tongue plate in the withdrawal direction is inhibited. If a load (a higher load) larger than a predetermined value is applied to the tongue plate in this condition, for example, during rapid reduction in speed of a vehicle, at least a portion of the lock plate is moved in the withdrawal direction. This causes the engagement means to be brought into an engaged state, thereby providing the engagement of the tongue plate with the buckle body, so that the movement of the lock plate in the direction of separation from the tongue plate is inhibited.

In addition, according to the present invention, there is provided a buckle apparatus for locking a tongue plate inserted therein, comprising a buckle body into which the tongue plate is inserted, a lock plate disposed in the buckle body and adapted to be brought into engagement with the inserted tongue plate by a swinging movement in a first direction, thereby locking the tongue plate, so that when a tensioning force larger than a predetermined value is applied to the tongue plate in the direction of withdrawal of the tongue plate in a condition of the tongue plate locked to the lock plate, the lock plate is deformed by such tensioning force in such a manner that at least a portion thereof is moved in a direction of withdrawal of the tongue plate, and an engagement means provided between the buckle body and the lock plate and adapted to be brought into an engaged state by the movement of the lock plate, thereby inhibiting the swinging movement of the lock plate in a second direction opposite from the first direction to prevent the engagement of the lock plate with the tongue plate from being released.

With such a construction, if a tensioning force larger than a predetermined value is applied to the tongue plate in the direction of withdrawal of the tongue plate, the lock plate is deformed in such a manner that a portion thereof is moved, and the engagement means is brought into its engaged state to permit the buckle body with the lock plate to be brought into engagement with each other, thereby inhibiting the swinging movement of the lock plate in the second direction, i.e., in a direction of disengagement from the tongue plate.

Further, according to the present invention, there is provided a buckle apparatus for locking a tongue plate inserted therein, comprising a buckle body into which the tongue plate is inserted, a lock plate disposed in the buckle body and adapted to be brought into engagement with the tongue plate by a movement in a first direction substantially perpendicular to a direction of insertion of the tongue plate, thereby locking the tongue plate, so that when a tensioning force larger than a predetermined value is applied to the tongue plate in the direction of withdrawal of the tongue plate in a condition of the tongue plate locked to the lock plate, the lock plate is moved by such tensioning force in a direction of withdrawal of the tongue plate, and an engagement means provided between the buckle body and the lock plate and adapted to be brought into an engaged state by the movement of the lock plate, thereby inhibiting the movement of the lock plate in a second direction opposite from the first direction to prevent the engagement of the lock plate with the tongue plate from being released.

With such a construction, if a tensioning force larger than a predetermined value is applied to the tongue plate in the direction of withdrawal of the tongue plate, the entire plate is moved, and the engagement means is brought into its engaged state to permit the buckle body and the lock plate to be brought into engagement with each other, thereby inhibiting the movement of the lock plate in the second direction, i.e., in a direction of disengagement from the tongue plate.

The buckle apparatus according to the present invention is constructed in the above manner and therefore, the lock plate can be retained despite a force component in the direction of disengagement of the lock plate from the tongue plate.

The above and other objects, features and advantages of the invention will become apparent from a reading of the following description of the preferred embodiments, taken in conjunction with the accompanying drawings.

BRIEF DESCRIPTION OF THE DRAWINGS

FIGS. 1 to 6 illustrate a first embodiment of a buckle apparatus according to the present invention, wherein FIG. 1 is an exploded perspective view of the entire buckle apparatus with a cover eliminated;

FIG. 2 is a partially cutaway perspective view of a release button;

FIG. 4 is a side view of the buckle apparatus in a condition of engagement with a tongue plate;

FIG. 6 is a side view of the buckle apparatus with the tongue plate disengaged therefrom;

FIGS. 7 to 13 illustrate a second embodiment of a buckle apparatus according to the present invention, wherein FIG. 7 is an exploded perspective view of the entire buckle apparatus;

FIG. 8 is a side view of the buckle apparatus before a tongue plate is engaged;

FIG. 9 is a plan view of the buckle apparatus with the tongue plate engaged therewith;

FIG. 10 is a sectional view taken along a line 10—10 in FIG. 9;

FIG. 11 is a side view of the buckle apparatus with the tongue plate engaged therewith;

FIG. 12 is a side view of the buckle apparatus when a higher load is applied; and FIG. 13 is a side view of the buckle apparatus when the tongue plate is disengaged therefrom.

DESCRIPTION OF THE PREFERRED EMBODIMENT

Figure 1:
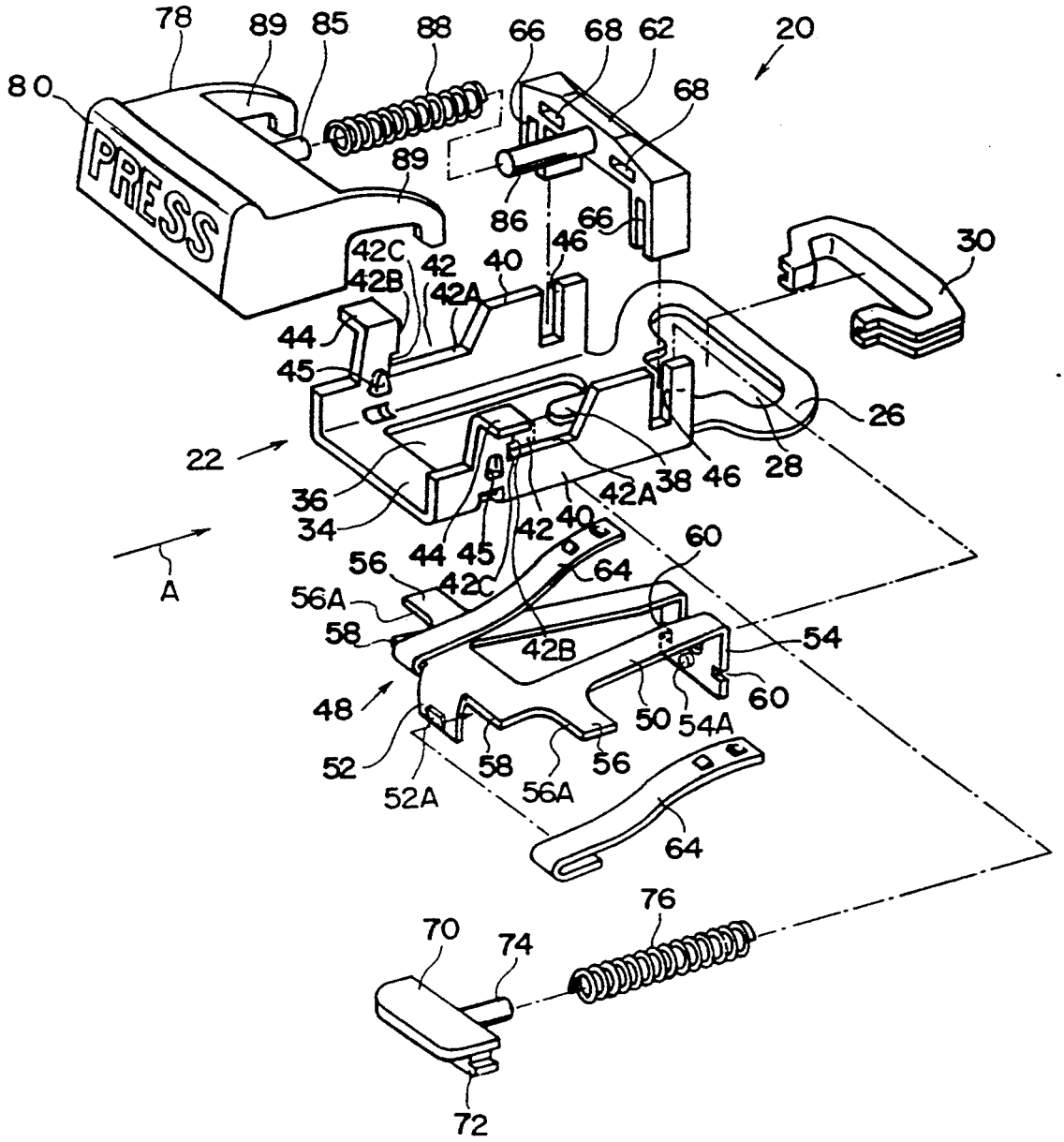

Referring to FIGS. 1 to 6 illustrating a first embodiment of a buckle apparatus according to the present invention, essential portions of the buckle apparatus 20 are contained in a buckle body 22.

The buckle body 22 is formed from a plate material having a predeterminedd strength, and has a connection 26 formed at one end thereof. The connection 26 is provided with an opening 28 to which a strap 32 is connected at one end thereof through a protector 30. The other end of the strap 32 is fixed to a vehicle body through an anchor plate or the like.

The buckle body 22 has an opening 36 provided in a base plate portion 34 which is a base bottom connected to the connection 26. The opening 36 is substantially ⌋-shaped with a projection 38 left centrally at a rear portion thereof. The buckle body 22 has also a substantially rectangular notch 42 provided in an intermediate and upper portion of each of leg plates 40 raised from opposite sides of the base plate portion 34 in parallel to each other. Guide flanges 44 are formed forwardly of the leg plates 40 adjacent the notches respectively to project away from each other in a bent manner. Each of the guide flanges 44 has a projection 45 provided on a lower portion thereof and embossed inwardly of the leg plate 40 for restricting the upward movement of a tongue plate inserted below the guide flange 44 in a direction of an arrow A to provide the positioning thereof.

A ⌋-shaped notch 42A is also provided at a side 42B of the notch 42 as viewed in a direction of withdrawal of the tongue plate (i.e., opposite from the direction of the arrow A).

Further, a notch 46 is provided rearwardly of the leg plate 40.

A lock plate 48 includes a pawl 52 centrally formed on a front end of a central flat plate 50 and bent downwardly, and a hinge portion 54 formed on a rear end of the central flat plate 50 and bent downwardly. The central flat plate 50 has projections 56 formed at front-side locations thereof to extend in widthwise oppposite directions, respsectively, and a longitudinally extending notch 50A defined in a central portion thereof and connected to the hinge portion 54.

Figure 3A:
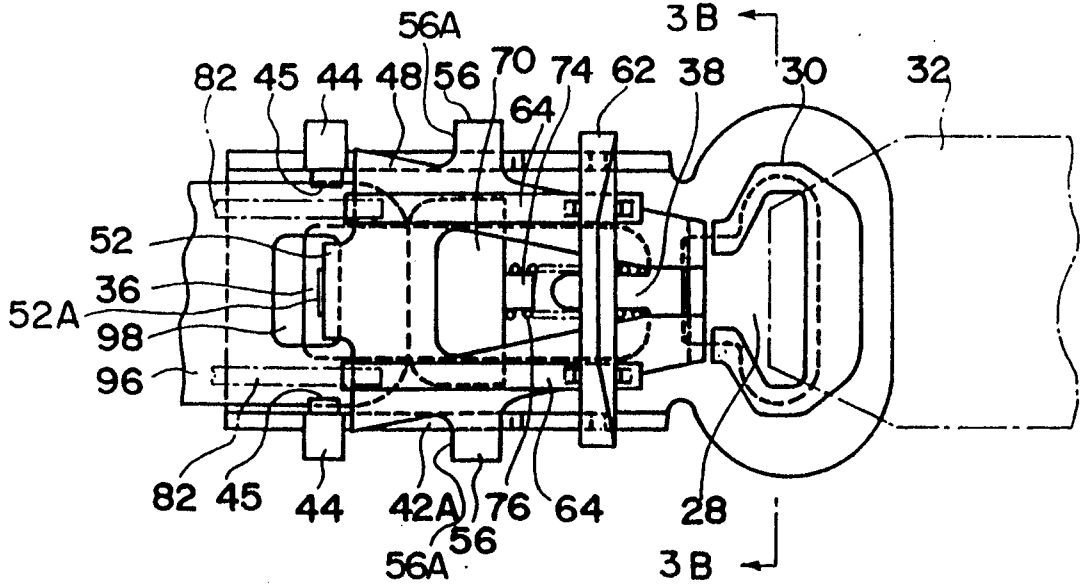
FIG. 3A is a plan view of the buckle apparatus shown in FIG. 1 with the cover eliminated.

As shown in FIG. 3A, the notch 50A is defined so that its width may be wider in the vicinity of the pawl 52 and narrower in the vicinity of the hinge portion 54.

The front end face of the central flat plate 50 located on opposite sides of the pawl 52 serves as a locking face 58.

The hinge portion 54 has notches 60 formed on opposite sides of a central portion thereof.

Figure 4:
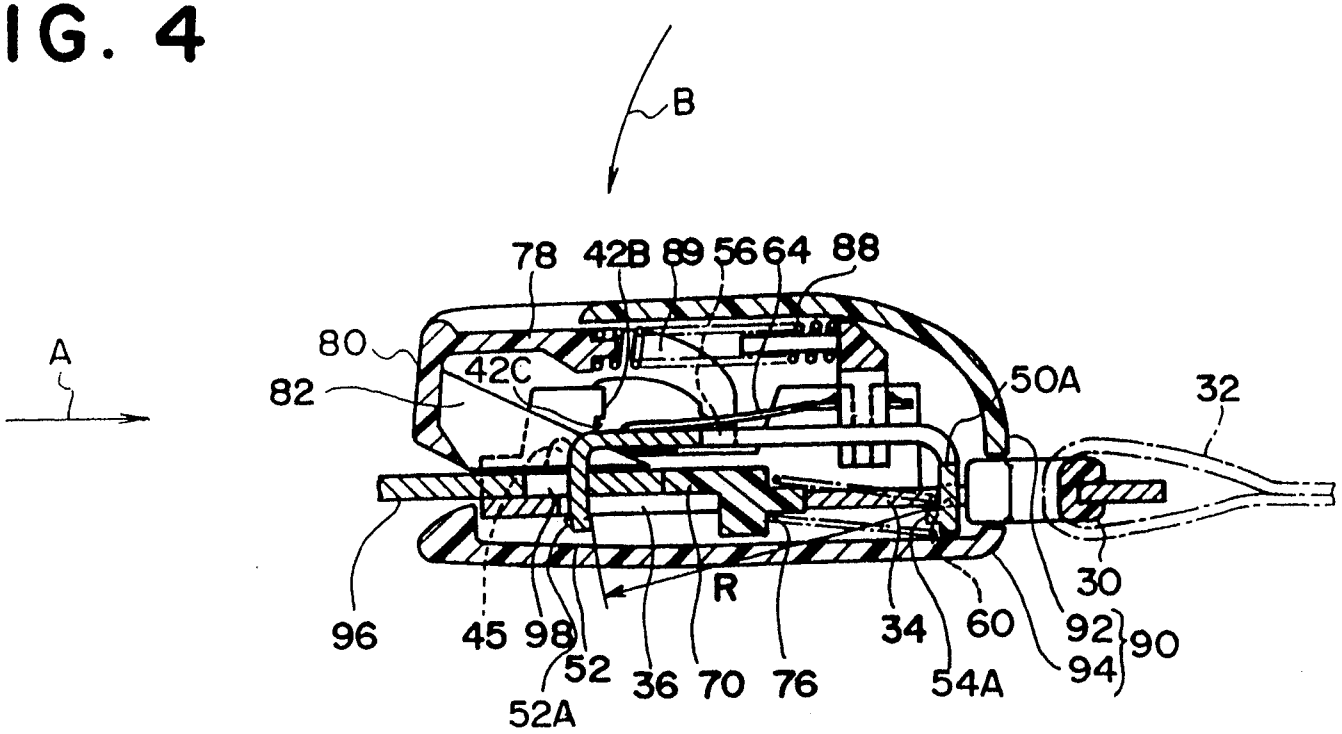

A side surface of the pawl 52 is formed into a arc of a circle having a radius R about the notch 60, as shown in FIG. 4, and the pawl 52 has a projection 52A of a trigonal prism shape provided at a forwardly leading end thereof perpendicularly to a forward direction of the pawl 52 and engageable with a forward edge of the opening 36.

Figure 3B:
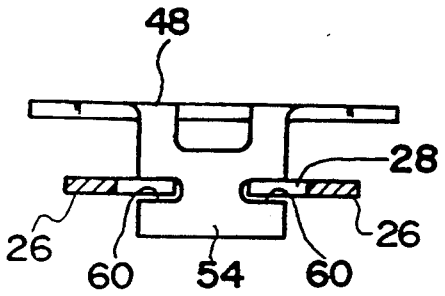
FIG. 3B is a sectional view taken along a line 3—3 in FIG. 3A.

The lock plate 48 is swingably constructed with the hinge portion 54 being inserted into the opening 28 defined in the connection 26 and with the notch 60 provided in the hinge portion 54 being locked to the connection as shown in FIG. 3B.

The protector 30 is fitted into the opening 28 after insertion of the lock plate 48 as described above and also serves as a member for preventing the slip-out of the lock plate 48.

A back face of the projection 56 of the lock plate 48 is capable of abutting against a bottom surface 42A of the notch 42 formed in the leg plate 40 of the buckle body.

With the lock plate 48 abutting against the bottom surface 42A, the leading end of the pawl 52 extends through the opening 36 provided in the base plate 34 of the buckle body.

A leaf spring 64 is supported at one end thereof by a holder 62 and locked at the other end thereof to the lock plate 48, so that the lock plate 48 is biased by the spring 64 under a rotational force in a counterclockwise direction (i.e., in a direction of an arrow B) as viewed in FIG. 4 about the notch 60 to engage the tongue plate.

The holder 62 is locked to the buckle body 22 with its notch 66 engaged with the notch 46 provided in the buckle body leg plate 40. The leaf spring 64 is inserted and locked in a small hole 68 made in the holder 62.

Figure 5A:
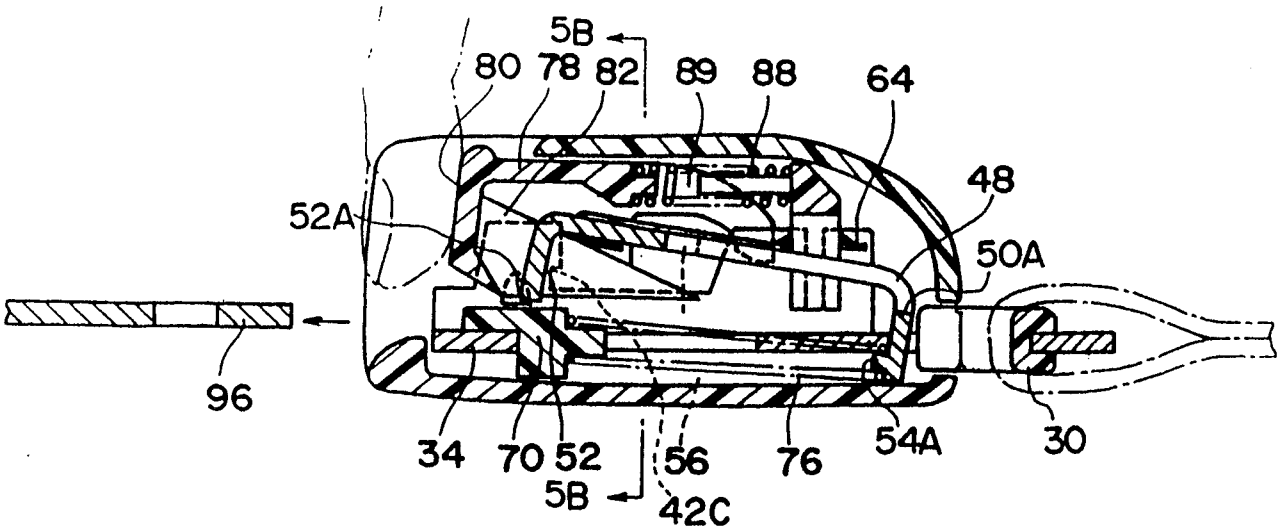
FIG. 5A is a side view of the buckle apparatus immediately after disengagement of the tongue plate.
Figure 5B:
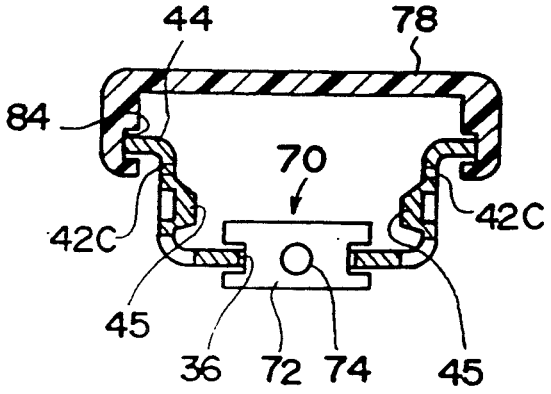
FIG. 5B is a sectional view taken along a line 5—5 in FIG. 5A.

An injector 70 is of a substantially rectangular parallelepiped shape with a flat upper portion wider than the opening 36 provided in the buckle body base plate 34 and has a guide portion 72 formed rearwardly at its lower portion and slidably fitted in the opening 36, as shown in FIG. 5B.

A spring-supporting portion 74 is projectingly formed at a rear location of the injector 70, and a compression coil spring 76 is disposed between the spring-supporting portion 74 and a projection 54A formed centrally at a lower end of a front surface of the hinge portion 54 located below the buckle body base plate portion 34, so that the injector 70 is biased leftwardly and upwardly as viewed in FIG. 4.

Figure 2:
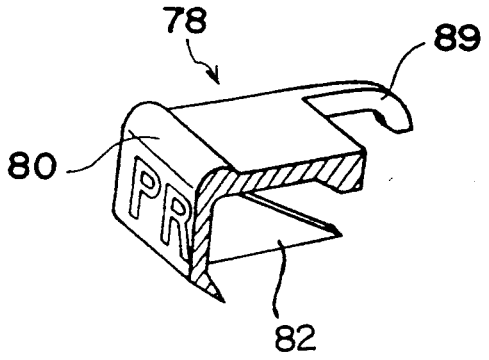

A release button 78 has wedge-like inclined guide portions 82 (only one of which is shown in FIG. 2) formed inside an operating portion 80, as shown in FIG. 2.

The inclined guide portion 82 is adapted to abut against the back surface of the lock plate 48 through the leaf spring 64, as shown by a dashed line in FIG. 3A.

The release button 78 has a rail groove 84 fitted with a guide flange 44 formed on the buckle body leg plate 40, as shown in FIG. 5B, so that it can be guided by the guide flange for rightward movement as viewed in FIG. 4.

A spring-supporting portion 85 is formed on the release button 78, and a compression coil spring 88 is disposed between the spring-supporting portion 85 and a spring-supporting portion formed on the holder 62, This ensures that the release button 78 is biased leftwardly as viewed in FIG. 4. The release button 78 includes retaining arms 89 formed on opposite sides thereof and having a leading end bent into a hook-shape. The retaining arms 89 are located so as to sandwich the buckle body leg plate 40 from the opposite sides.

Figure 6:
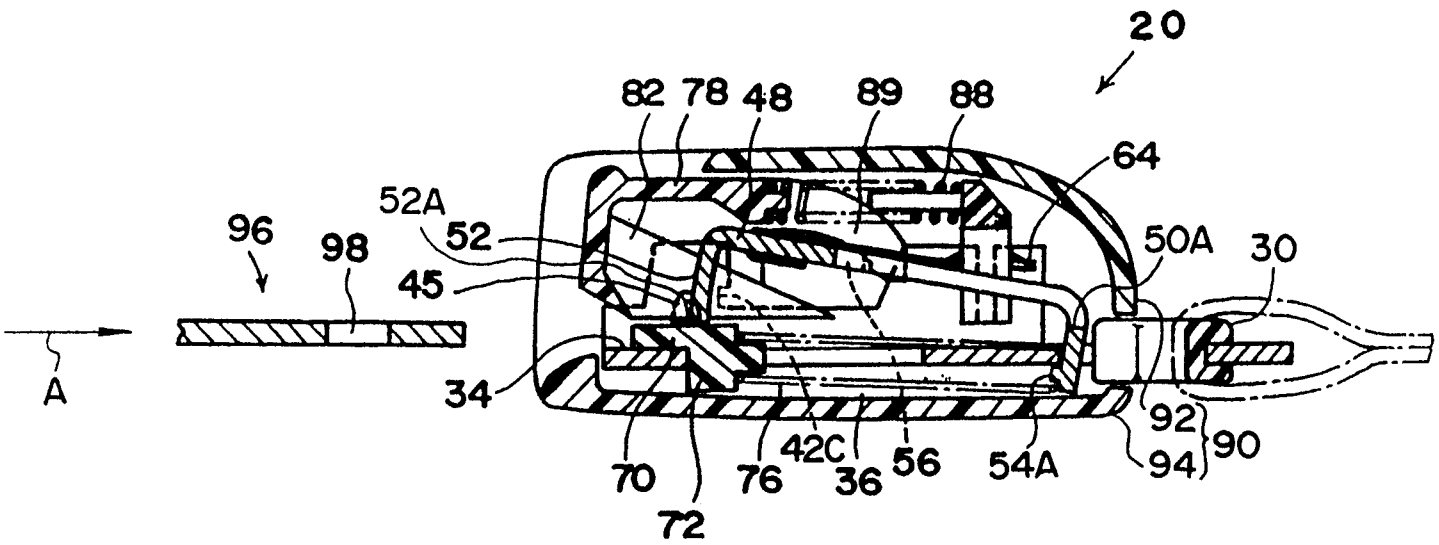
Figure 7:
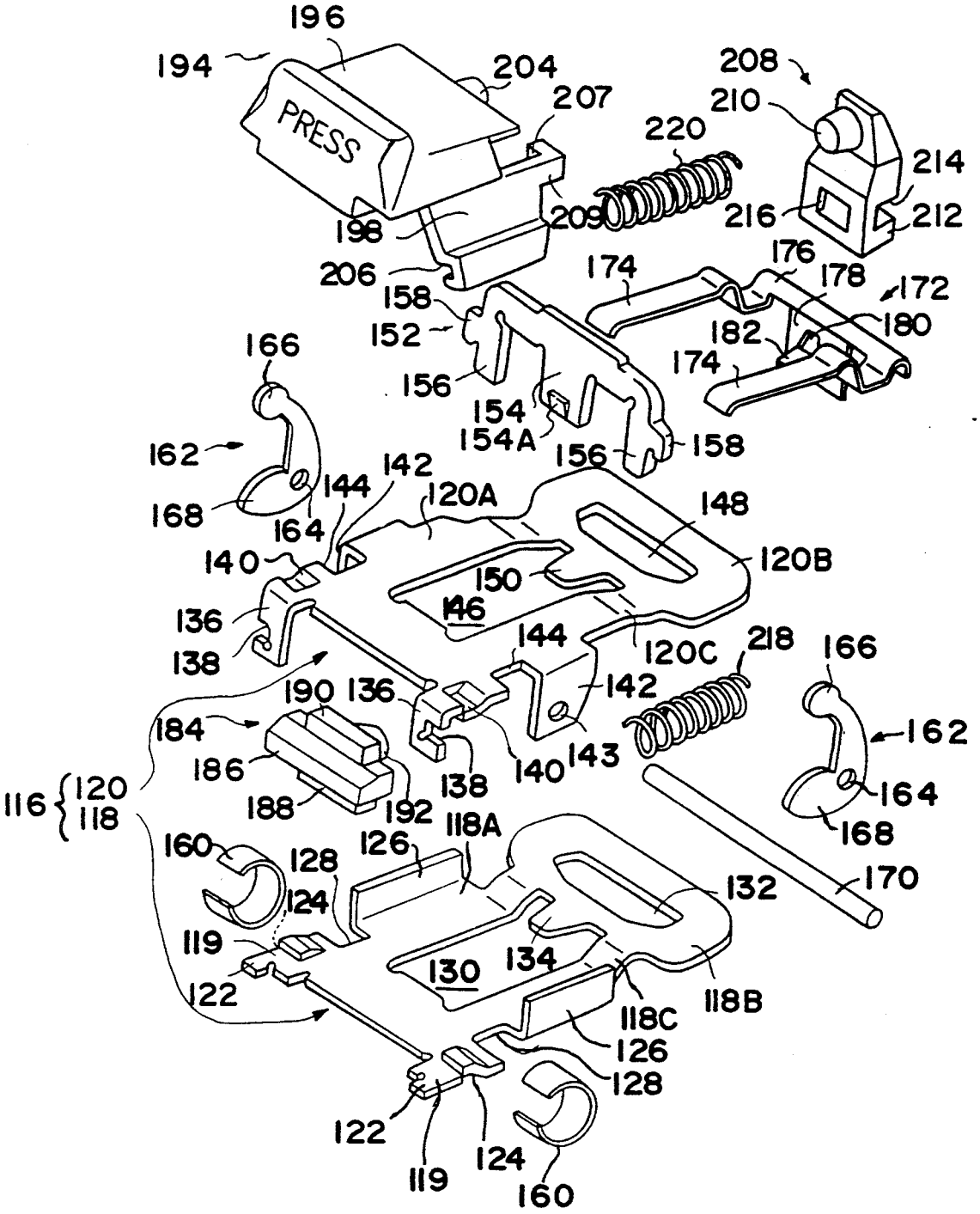

A buckle cover 90 is fixed to the buckle body 22 to cover the base plate portion 34 and the leg plate portion 40 of the buckle body 22 and is comprised of an upper cover member 92 and a lower cover member 94, as shown in FIG. 6.

A tongue plate 96 has a rectangular opening 98 provided at a location closer to a leading end thereof, and a webbing, which is not shown, is attached at one end to a rear end of the tongue plate 96.

The other end of the webbing is adapted to be fixed to the vehicle body through an anchor plate or the like.

The operation of the first embodiment will be described below.

Shown in FIG. 6 is a condition before the tongue plate 96 is brought into engagement with the buckle apparatus 20.

In this condition, the injector 70 is biased leftwardly and upwardly by the compression coil spring 76 and located at a limit of forward movement, with the guide portion 72 abutting against an end face of the opening 36 provided the buckle body base plate portion 34.

The pawl 52 of the lock plate 48 is in abutment against an upper surface of the injector 70. The pawl 52 urges the upper surface of the injector 70, because the lock plate 48 is biased under the rotational force in the counterclockwise direction by means of the leaf spring 64.

The release button 78 is biased by the compression coil spring 88, but does not reach the limit of forward movement, because the leading end of the retaining arm 89 is locked to the projection 56 of the lock plate 48.

If the tongue plate 96 is inserted (in the direction of the arrow A) between the base plate portion 34 and the projection 45 of the buckle apparatus in this condition, the leading end of the tongue plate urges the injector 70 in the direction of the arrow A in FIG. 6.

If the injector 70 is moved rightwardly against a biasing force of the compression coil spring 76, the leading end of the tongue plate 96 is located below the leading end of the pawl 52 of the lock plate 48. If the tongue plate 96 is further urged rightwardly, the leading end of the pawl 52 of the lock plate 48 is located above the opening 98 in the tongue plate 96 and then urged in rotative movement into the opening 98 in a moment, because the lock plate 48 is biased in the counterclockwise direction.

The lock plate 48 is rotated so that the leading end of the pawl 52 is passed through the opening 98 in the tongue plate 96 and located into the opening 36 provided in the buckle body base plate portion 34. Then, the front back surface including the projection 56 abuts against the bottom surface 42A of the notch 42 provided in the buckle body leg plate portion 40 and thus, the rotation of the lock plate 48 is stopped.

If the lock plate 48 is rotated, the retaining arms 89 of the release button 78 are released from locked engagement with the projection 56 of the lock plate 48, so that the release button 78 is biased by the compression coil spring 88 to reach the lefthand limit of forward movement.

This condition is shown in FIGS. 3A and 4, and in this condition, the tongue plate 96 is urged slightly leftwardly and upwardly by the injector 70 biased by the compression coil spring 76 and therefore, on looseness, can be produced between the tongue plate 96 and the lock plate 48.

In addition, since the rear end of the compression coil spring 76 is fixed to the projection 54A located below an axial center of the injector 70, a clockwise rotational moment is applied to the tongue plate 96 through the injector 70.

Further, since the lock plate 48 is in an urged abutment against the buckle body 12 in a condition in which the counterclockwise rotational force is provided thereto by the leaf spring 64, the engagement of the lock plate with the tongue plate 96 cannot be released without the releasing provided by an operator, in combination with a following action.

The abutment portion of the hinge portion 54 in the lock plate 48 against the buckle body 22 is located below the engagement portion between the lock plate 48 and the tongue plate 96, as shown in FIG. 4.

Therefore, if a force is applied to pull the tongue plate 96 through the webbing leftwardly as viewed in FIG. 4, for example, during rapid reduction of speed of the vehicle, the rotational moment of the lock plate 48 acts in the counterclockwise direction as viewed in FIG. 4 (i.e, in the direction of the arrow B).

This provides an increased strength of engagement between the lock plate 48 and the tongue plate 96, so that the engagement between the lock plate 48 and the tongue plate 96 cannot be released without releasing by the operator.

In this condition, the projection 52A of the pawl 52 is passed through the base plate portion 34 and located on the side of the lower cover portion 94.

Further, the leading end of the retaining arm 89 of the release button 78 is located above the projection 56 of the lock plate 48 and hence, the clockwise rotation of the lock plate 48 is restrained.

If a large tension is applied to the webbing in a condition of the tongue plate 96 is engagement with the buckle apparatus 20, the lock plate 48 is deflected and deformed because of the large notch 50A provided longitudinally in the central flat plate portion 50, so that the leading end of the pawl 52 abuts against the end face of the opening 36 made in the buckle body base plate portion 34, and the locking surface 56A on the base of the projection 56 enters the notch 42C provided in the buckle body leg plate portion 40. Further, the projection 52A is brought into engagement with the edge of the opening 36 to prevent the rotation of the tongue plate 96 in a disengaging direction (i.e., in a direction opposite from the direction of the arrow B).

For this purpose, it is preferable that the side of the projection 52A opposite from the base plate portion 34 is suddenly raised from the pawl 52 and may be brought reliably into engagement with the base plate portion 34.

Further, even if the direction of a load applied from the tongue plate 96 onto the lock plate 48 is offset, so that a component thereof is applied in a direction to disengage the lock plate 48 from the tongue plate 96, the rotation of the lock plate 48 in the direction opposite from the direction of the arrow B is inhibited and hence, the engagement of the tongue plate 96 cannot be inadverently released.

In this condition, the lock plate 48 is supported with its two places sandwiching the tongue plate 96 being in abutment against the buckle body 22 in the vicinity of the engaged portion with the tongue plate 96, thereby supporting the tongue plate 96 on the opposite sides thereof. This insures an extremely high supporting strength for the tongue plate 96 to permit a reliable retaining of the engagement between the lock plate 48 and the tongue plate 96.

It should be noted that if a large tension on the tongue plate 96 is released, the deformation of the central flat plate portion 50 is resiliently released, resulting in spaces provided between the projection 52A formed at the leading end of the pawl 52 and the end face of the opening 36 and between the locking surface 58 and the side 42B of the notch 42.

In addition, not only the pawl 52 but also the entire lock plate is deformed when the large tension is applied to the webbing and therefore, the amount of deformation per unit area is smaller and a plastic deformation is prevented.

It should be also noted that a portion of the notch 50A extending from the central flat plate portion 50 to the hinge portion 54 which is in the vicinity of the hinge portion 54 conveniently contributes to the deflection of the lock plate 48.

In releasing the engagement between the buckle apparatus 20 and the tongue plate 96, if the operating portion 80 is urged from the state shown in FIGS. 3A and 4 to move the release button 78 rightwardly against the biasing force of the compression coil spring 88, the inclined guide portions 82 of the release button 78 are urged to abut against the leaf spring 64 located on the back of the lock plate 48.

The movement of the release button 78 causes the leading ends of the retaining arms 89 to move from the projection 56 of the lock plate 48, while at the same time, permitting the lock plate 48 to move upwardly along the inclined guide portions 82, so that the lock plate 48 is swung in the clockwise directions as viewed in FIG. 4 about the abutment portion of the hinge portion 54 against the buckle body 22.

As soon as the lock plate 48 is swung so that the leading end of the pawl 52 is separated from the opening 98 in the tongue plate 96, the injector 70 is biased by the compression coil spring 76 and moved leftwardly in a moment to drive the tongue plate 96 out of the buckle apparatus 20. This condition is shown in FIG. 5A.

If the release button 78 is released after releasing of the engagement between the lock plate 48 and the tongue plate 96, the release button 78 is biased by the compression coil spring 88 to move leftwardly as viewed in FIG. 5A back to the state shown in FIG. 6.

It is to be noted that during urging of the release button 78, the inclined guide portion 82 provides a wedge effect (a principle of slant) to the lock plate 48 and therefore, an increased urging force of the release button 78 is applied.

Therefore, a counterclockwise large rotational momemt about the abutment portion of the hinge portion 54 against the buckle body 22 is applied to the lock plate 48 and hence, a relatively small force is only required to release the tongue plate 96. In addition, the inclined guide portion 82 is brought into urged abutment against the curved portion of the leaf spring 64, resulting in a smaller resistance of friction to require only a reduced releasing force.

Also, since the retaining arms 89 are formed on the release button 78 so that they are opposed to the corresponding projections 56 of the lock plate 48, any inadvertent releasing is prevented even if there is a shock force in a releasing direction.

Alternatively, the lock plate 48 may be of either a construction such that when a tension load is applied to the lock plate 48, the projection 52A of the lock plate 48 engages the edge of the opening 36 in the buckle body 22, or a construction such that the locking surface 56A located at the base of the projection 56 engages the notch 42C in the buckle body 22.

A second embodiment of the present invention is shown in FIGS. 7 to 13.

A buckle body 116 is comprised of a lower body member 118 and an upper body member 120.

The lower body member 118 is formed from a single steel sheet having a given strength and includes a front flat plate portion 118A and a rear flat plate portion 118B which are interconnected by an inclined portion 118C having an up-grade from the front flat plate portion 118A toward the rear flat plate portion 118B.

The front flat plate portion 118A is formed with front legs 119 extending forwardly from the front opposite ends thereof.

The front legs 119 has projections 122 formed thereon in a stepped manner by cutting-away of its front and inner portion.

The front flat plate portion 118A has a recess 124 made therein rearwardly of each of the front legs by shearing and bending.

The front flat plate portion 118A also has a side leg 126 formed on a side thereof rearwardly of each of the recesses 124 and bent and raised upwardly at a right angle.

A notch 128 is defined between the recess 124 and the side leg 126. A rectangular opening 130 is centrally provided in the front flat plate portion 118A to extend toward the rear flat plate portion 118B.

The rear flat plate portion 118B is provided with a trapezoidal opening 132 and a trapezoidal tongue piece 134 projecting into the opening 130.

The upper body member 120 is formed from a single steel sheet having a given strength and includes a front flat plate portion 120A and a rear flat plate portion 120B which are interconnected by an inclined portion 120C having an down-grade from the front flat plate portion 120A toward the rear flat plate portion 120B.

The front flat plate portion 120A has front legs 136 formed at its front opposite ends and bent to extend dowwardly at a right angle.

Each of the front legs 136 has a notch 138 provided at an outer side of an intermediate portion thereof.

The front flat plate portion 120A has a recess 140 made therein rearwardly of each of the front legs 136 by shearing and bending, and a through hole 143 made in each of side legs 142 which are provided rearwardly of the corresponding recesses 140 and bent to extend downwardly at a right angle.

A notch 144 is provided between the recess 140 and the side leg 142.

A rectangular opening 146 is centrally provided in the front flat plate portion 120A to extend toward the rear flat plate portion 120B.

The rear flat plate portion 120B is provided with a trapezoidal opening 148 and a trapezoidal tongue piece 150 projecting into the opening 146.

A lock plate 152 is formed into a substantially E-shaped profile from a single steel sheet having a given strength, and includes a leg projectingly provided at its central portion in the form of a tongue plate-engaging portion 154 and legs projectingly provided at opposite ends thereof in the form of C-shaped spring abutment portions 156.

A leading end of a front surface of the tongue plate-engaging portion 154 is formed with a trigonal prism-shaped projection 154A which has sides perpendicular to the front surface of the tongue plate-engaging portion 154 and is engageable with a front edge of the opening 130 and which has a function similar to that in the previously described first embodiment.

Each of the C-shaped spring-abutting portion 156 has a lever-abuting portion 158 formed thereon to project widthwisely outwadly.

A lever 162 is a plate member formed into a substantially L-shaped profile and includes a through hole 164 made in an intermediate bent portion thereof, a release button-abutting portion 166 on a longer side, and a lock plate-abutting portion 168 on a shorter side.

It should be noted that the lever 162 has a lever ratio of about 2:1.

A bar 170 is columnar and can be formed integrally with the lever 162 from a synthetic resin.

A lock plate spring 172 is a spring of a ]-shaped planar configuration and has a buckle body-fixed portion 178 formed at a connection 176 between a pair of legs 174 to extend downwardly.

A trapezoidal opening is formed in the fixed portion 178, and a portion located therein prior to the formation of this opening is raised at a right angle from the fixed portion 178 in the form of a trapezoidal tongue piece 182 by cutting.

An injector 184 is comprised of a main body 186, a lower guide portion 188, an upper guide portion 190 and a spring supporting portion 192, all of which are formed integrally.

The main body 186 is formed into a substantially rectangular parallelepiped shape with an inclined surface formed on its front upper surface.

The lower and upper guide portions 188 and 190 are each formed into a rectangular parallelepiped shape shorter in widthwise length than the main body and are located below and above a central rear portion of the main body 186, respectively.

The spring-supporting portion 192 is formed into a substantially frusto-conical shape with its bottom located behind the main body 186 and the lower and upper guide portions 188 and 190.

A release button 194 comprises a main body 196 and a pair of legs 198 extending downwardly from opposite sides of the main body 196, all of which are formed integrally.

Figure 8:
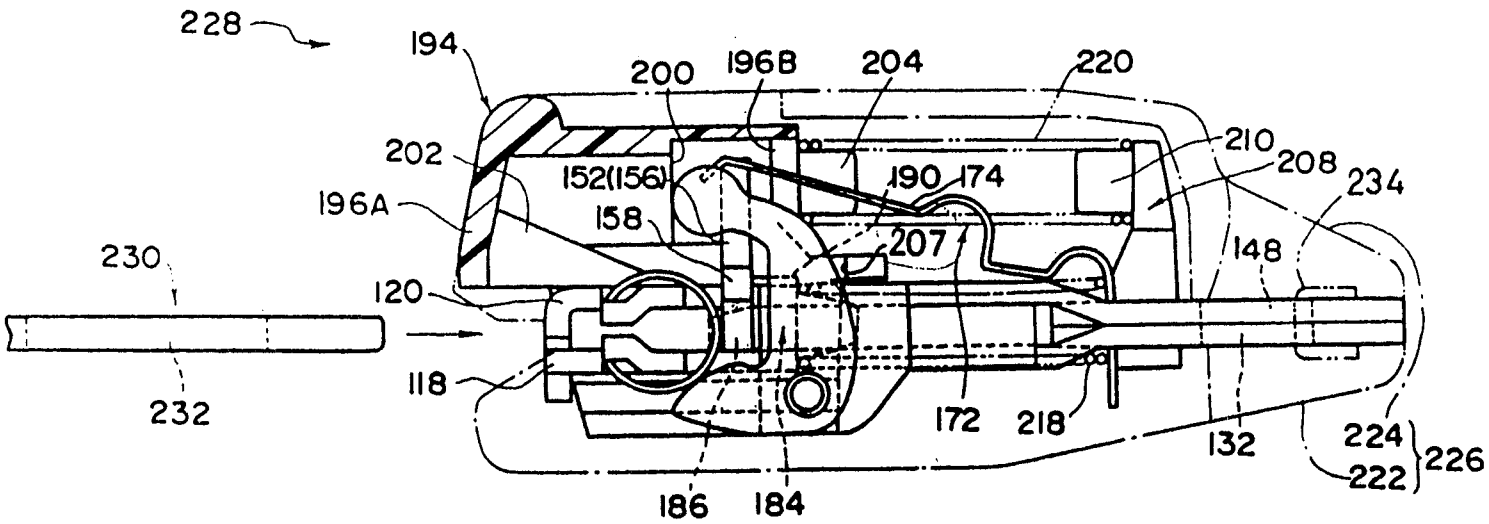
Figure 9:
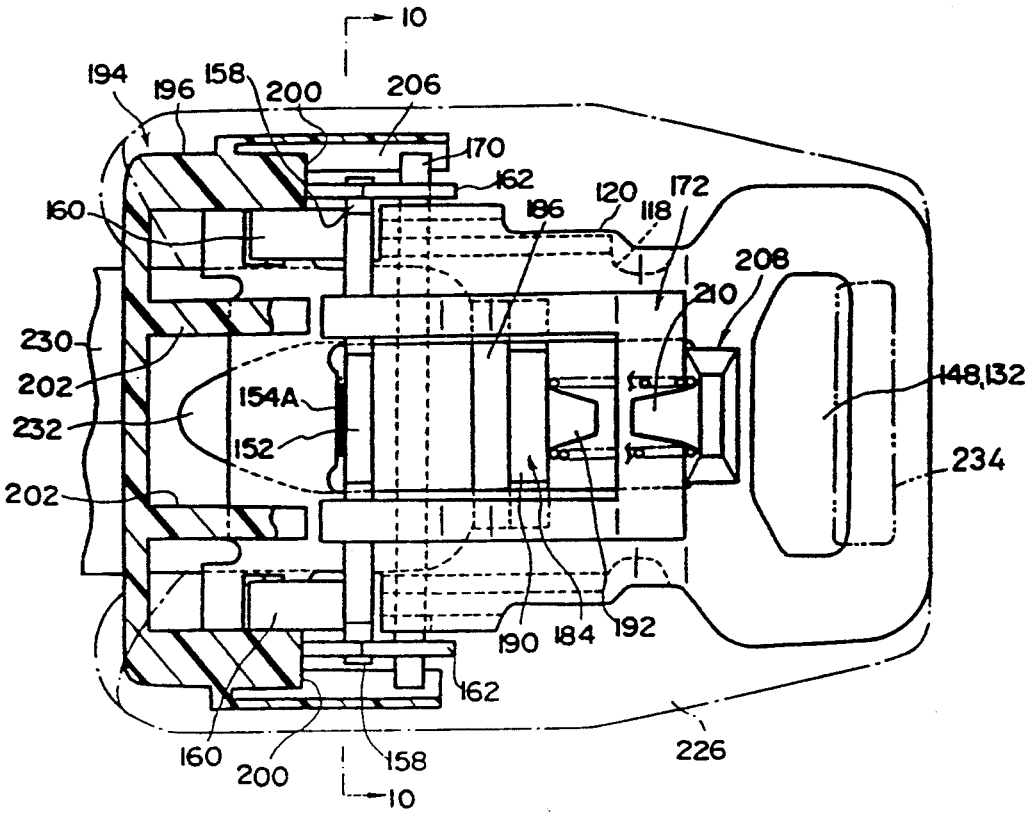

The main body 196 has lever-abutting walls 200 formed on inner opposite sides thereof, and a wedge-shaped slide guide wall 202 widthwisely inwardly of the lever-abutting walls 200 to project from a front wall 196A, as shown in FIG. 8.

The main body 196 is also formed with a columnar spring-supporting portion 204 projecting rearwardly from a rear wall 196B.

The leg 198 includes a longitudinally extending groove 206 provided in an inner surface thereof, and an extension 209 which has a lever-abutting portion 207 formed at a rear end thereof.

A spring holder 208 is provided with a columnar spring-supporting portion 210 and a fixing portion 212.

The fixing portion 212 includes a widthwisely extending groove 214 provided on a side opposite from the spring-supporting portion 210, and an opening 216 of a rectangular section made longitudinally therethrough to communicate with the groove 214.

An injector spring 218 and a release button spring 220 are each a compression coil spring.

Description will now be made of a procedure for assembling the above-described components.

The injector 184 is disposed in the opening 130 in the lower body member 118.

The lower guide portion 188 of the injector 184 is fitted into the opening 130 and then, the upper body member 120 is assembled to the lower body member 118.

The notches 138 provided in the front legs 136 of the lower body member 118 are fitted into the notches 138 provided in the front legs 136 of the upper body member 120, respectively, so that the upper body member 120 is assembled to form the buckle body 116.

In this condition, the upper guide portion 190 of the injector 184 is fitted into the opening 146 in the upper body member 120.

The rear flat plate portion 118B and the tongue piece 134 of the lower body member 118 abut against and overlap on the rear flat plate portion 120B and the tongue piece 150 of the upper body member 120, respectively.

The opening 216 made in the fixing portion 212 of the holder 208 is fitted over the overlapped tongue pieces 134 and 150. This fitting causes the groove 214 defined is the fixing portion 212 to be fitted over the respective rear flat plate portions 118B and 120B of the lower and upper body members 118 and 120, thereby clamping the rear flat plate portions 118B and 120B in their overlapped states.

A C-shaped spring 160 is fitted at its intermediate portion into the notches 128 and 144 made in the lower and upper body members 118 and 120 and is locked at opposite ends into the respective recesses 124 and 140 provided in the body members 118 and 120.

The lock plate 152 is assembled to the buckle body 116 from the above of the upper body member 120, so that the tongue plate-locking portion 154 is inserted into the opening 146, and the C-shaped spring-abutting portion 156 is inserted into the notch 144.

Further, the opening 180 defined in the fixing portion 178 of the lock plate spring 172 is fitted over the overlapped tongue pieces 134 and 150, and one end of the injector spring 218 is also fitted over the overlapped tongue pieces 134 and 150.

The other end of the injector spring 218 is fitted over the spring-supporting portion 192 formed on the injector 184.

This ensures that the injector 184 is biased leftwardly as viewed in FIG. 8 by the injector spring 218.

The lower end of the tongue plate-locking portion 154 abuts against the upper surface of the main body 186 of the injector 184, and the back surface of the tongue plate-locking portion 154 abuts against the front surface of the upper guide portion 190 of the injector 184.

The free ends of the legs 174 of the lock plate spring 172 are locked to the upper end face of the lock plate 152, so that the lock plate 152 is biased downwardly as viewed in FIG. 8.

The bar 170 is inserted through the through holes 143 made in the side legs 142 of the upper body member 120 to transverse the back surface of the lower body member 118.

The L-shaped levers 162 are fitted, at their through holes 164, over the opposite ends of the bar 170, respectively.

It should be noted that when the levers 162 and the bar 170 are integrally formed of a synthetic resin, the bar 10 can be assembled by opening a portion of the through holes 143 made in the side legs 142 of the upper body member 120.

The release button 194 is assembled to the buckle body 116 in such a manner that the opposite ends of the bar 170 are fitted into the grooves 206 made in the legs 198, and the slide guide wall 202 abuts against the upper surface of the upper body member 120.

One end of the coil of the release button spring 220 is fitted over the spring-supporting portion 204 of the release button 194, and the other end of the coil of the release button spring 220 is fitted over the spring-supporting portion 210 of the spring holder 208.

This ensures that the release button 194 is biased leftwardly as viewed in FIG. 8.

Finally, the buckle cover 226 comprising the lower and upper cover members 222 and 224 shown in FIG. 8 is assembled to the buckle body 116.

It is to be noted that the webbing (not shown) fixed at its one end to the vehicle body through the protector 234 is attached at the other end thereof into the openings 132 and 148 made in the respective rear flat plate portions 118B and 120B of the overlapped upper and lower body members 120 and 118.

In addition, an opening 232 is provided in a tongue plate 230 which is engaged into the buckle apparatus 228, as shown in FIG. 8.

The webbing (not shown) fixed at its one end to the vehicle body is attached at the other end to the tongue plate 230.

The operation of the second embodiment will be described below.

A condition before engagement of the tongue plate 230 into the buckle apparatus 228 is shown in FIG. 8.

If the tongue plate 230 is inserted into the buckle apparatus 228 from the left as viewed in FIG. 8 in this condition, the tongue plate 230 is brought into engagement with the buckle apparatus 228, so that the occupant can wear the webbing.

When the tongue plate 230 is inserted into the buckle apparatus 228, the leading end of the tongue plate 230 abuts against the front surface of the main body 186 of the injector 184 to urge the injector 184 rightwardly as viewed in FIG. 8 against the biasing force of the injector spring 218.

The tongue plate 230 is moved rightwardly as viewed in FIG. 8 while urging the injector 184, until the opening 232 reaches the below of the tongue plate-engaging portion 154 of the lock plate 152.

The lock plate 152 is biased downwardly as viewed in FIG. 8 by the lock plate spring 172 and hence, when the tongue plate 230 has reached the above-described location, the leading end of the lock plate engaging portion 154 is passed downwardly as viewed in FIG. 8 through the opening 130 in the lower body member 118.

This causes the tongue plate 230 to be brougnt into engagement with the buckle apparatus 228.

Figure 10:
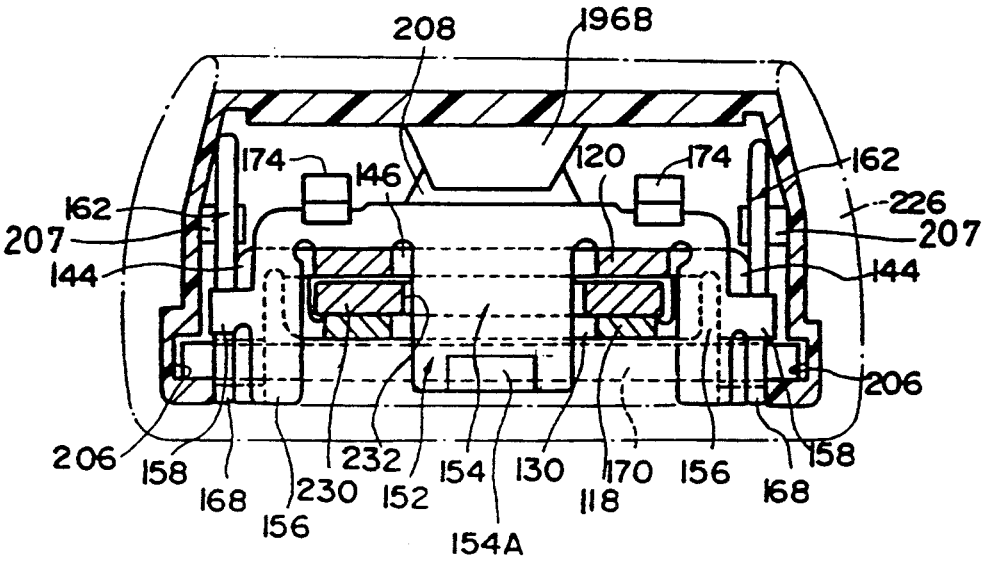
Figure 11:
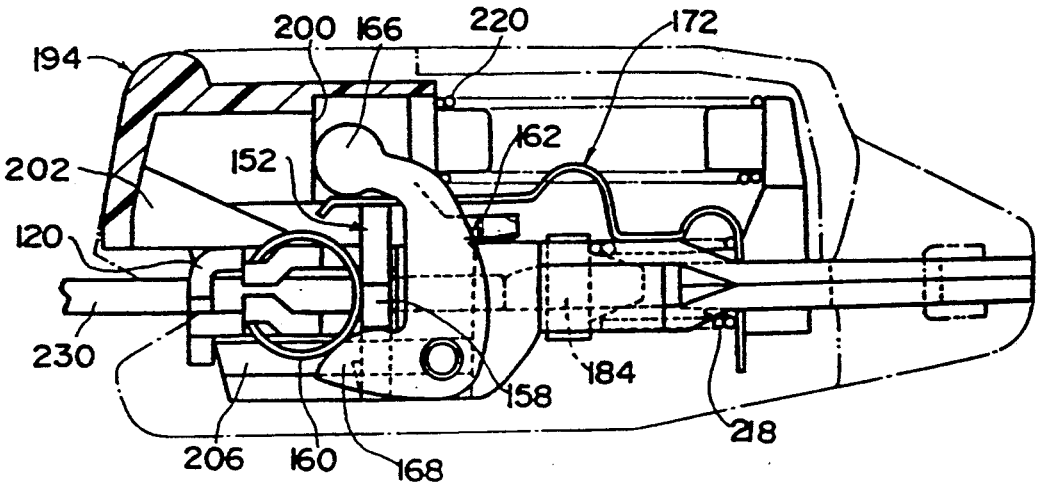
Figure 12:
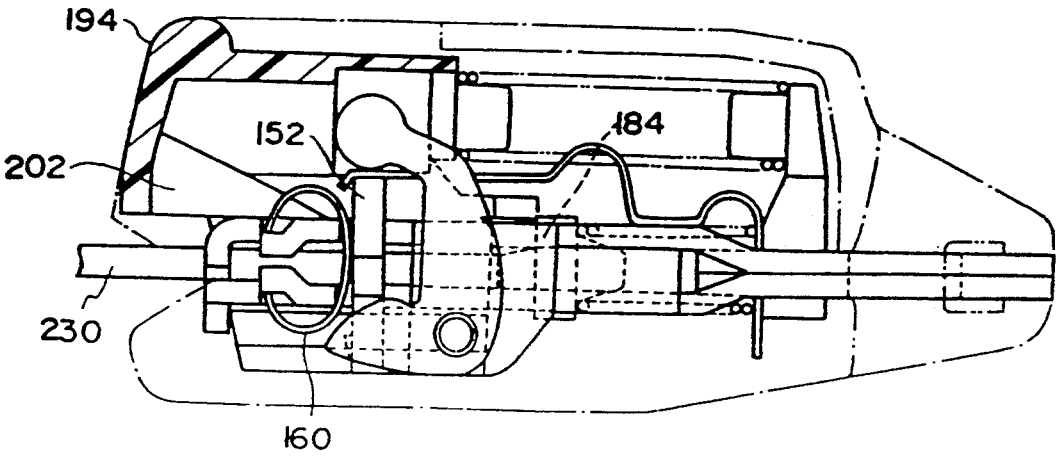

This condition is shown in FIGS. 10 and 11.

If a large tensioning force is applied leftwardly as viewed in FIG. 11 to the tongue plate 230 through the webbing (not shown) in the condition shown in FIG. 11, the lock plate 152 is moved leftwardly as viewed in FIG. 11 against the biasing force of the C-shaped spring 160, so that the upper and lower portions of the tongue plate-engaging portion 154 abut against and are locked to the front end faces of the openings 130 and 146 made in the lower and upper body members 118 and 120.

Further, even if the direction of a load applied from the tongue plate 230 to the lock plate 152 is offset so that the lower body member 118 is deflected away from the lock plate 152, the projection 154A formed on the tongue plate-engaging portion 154 is brought into engagement with the front end face of the opening 130 and therefore, the engagement of the tongue plate with the buckle body 116 is maintained.

In releasing the engagement between the tongue plate 230 and the buckle apparatus 228, the release button 194 may be moved rightwardly from the condition shown in FIG. 11 against the biasing force of the release button spring 220.

The release button 194 is moved with the lower end of the slide guide wall 202 in abutment against the upper surface of the upper body member 120 and with the lever abutting walls 200 in abutment against the release button abutting portion 166 of the lever 162.

Therefore, the movement of the release button 194 causes the release button-abutting portion of the lever 162 to be moved rightwardly, while causing the lock plate abutting portion 168 to be swung in a clockwise direction as viewed in FIG. 11.

The swinging movement of the lock plate-abutting portion 168 causes the lever-abutting portion 158 to be urged upwardly, so that the lock plate 152 is moved upwardly against the biasing force of the lock plate spring 172.

The upward movement of the lock plate 152 results in the tongue plate-engaging portion 154 being moved out of the opening 232 in the tongue plate 230.

At the same time, the injector 184 is biased by the injector spring 218 and moved leftwardly as viewed in FIG. 11, so that the tongue plate 230 is urged by the injector 184 and driven out of the buckle apparatus 228.

Figure 13:
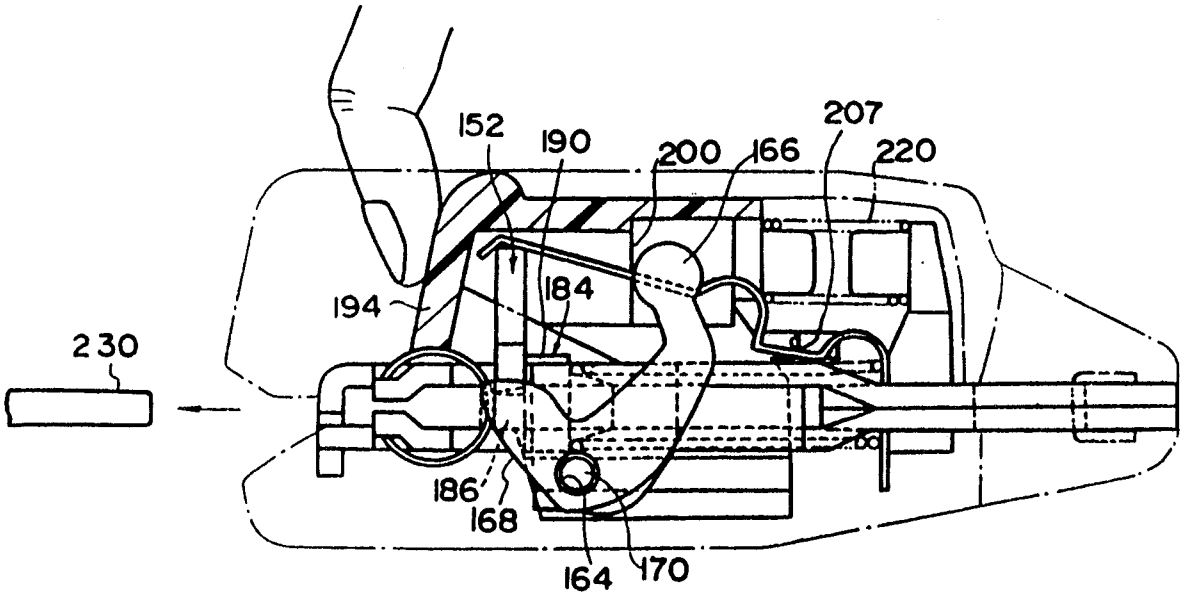

This condition is shown in FIG. 13, and in this condition, the movement of the injector 184 is inhibited with the front surface of the upper guide portion 190 being in abutment against the back surface of the tongue plate-engaging portion 154 of the lock plate 152.

In addition, the downward movement of the lock plate 152 is also inhibited with the lower end face of the tongue plate-engaging portion 154 being in abutment against the upper surface of the main body 186 of the injector 184.

If the operation of the release button 194 is released from the condition shown in FIG. 13, the release button 194 is biased by the release button spring 220 and moved leftwardly as viewed in FIG. 13, so that the levers 162 are urged by the lever abutting walls 207 formed on the extension 209 back to their states shown in FIG. 8, respectively.

In such second embodiment, the buckle body 116 is comprised of the lower bodymember 118 and the upper body member 120, so that the tongue plate 230 may be placed into a clearance defined between the body members.

The lock plate 152 is vertically movably disposed across the clearance, and the lock plate 152 is supported in an urged and clamped manner by the C-shaped spring 160 and the injector 184 in a condition in which the tongue plate 230 is not engaged with the lock plate 152.

In addition, the tongue plate 230 may be supported on the opposite sides, resulting in an increased reliability of engagement, and the support span is shorter, leading to a larger supporting strength.

It should be noted that when a lower load is applied in a condition in which the tongue plate 230 is in engagement with the lock plate 152, the lock plate 152 is resiliently supported through the C-shaped springs 160.

The C-shaped springs 160 are resiliently deformed even due to a variation in load in a range of such lower loading, but the injector 184 biased by the injector spring 218 is moved through the tongue plate 230 in a manner to follow the resilient deformation of the C-shaped springs 160 and therefore, any looseness cannot be produced between the tongue plate 230 and the lock plate 152.

It should be also noted that if a higher load is reduced into a lower level, the above-described condition is reliably established by the biasing force of the C-shaped spring 160.

Therefore, when the lock plate 152 is urged up by the levers 162 during disengagement of the tongue plate 230, the lock plate 152 is merely in abutment against the C-shaped spring except for the engagement with the tongue plate 230.

The lock plate-supporting surface of the buckle body 116 against which the lock plate 152 abuts when a higher load is applied is relatively rough, because it is a press-cut surface.

On the other hand, the C-shaped spring 160 is a rolled material and hence, the surface thereof is relatively smooth.

For this reason, any marring of the lock plate 152 cannot be produced during disengagement of the tongue plate 230. In addition, even the lock plate marred due to the abutment against the buckle body 116 can be guided by the C-shaped springs 160 and therefore, in the course of service, the force required for releasing cannot be increased.

Particularly, the lever 162 has a leverage and hence, a reduced force is only required therefor.

Additionally, even if a depression should be produced in the buckle body-abutting surface of the lock plate 152 as a result of application of a higher load, the lock plate 152 is separated apart from the buckle body 116 by the C-shaped springs 160 during disengagement and therefore, the lock plate 152 cannot be meshed with the buckle body 116, resulting in a difficulty of disengagement.

Figure 14:
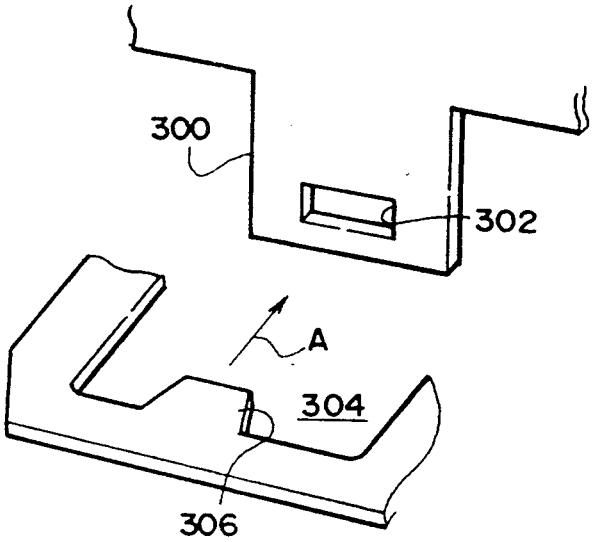
FIG. 14 is a perspective view of engagement retaining means in a lock plate and a tongue plate in accordance with a third embodiment.

A third embodiment of the present invention is shown in FIG. 14. In the third embodiment, a rectangular through hole 320 is made in a leading end of an engaging portion 300 of a lock plate with a buckle body base plate portion, and a trapezoidal tongue piece 306 is formed on a front edge of an opening 304 in the buckle body base plate portion to project in a direction of an arrow A, so that it can be inserted into the through hole 302.

This ensures that if the lock plate is moved under the influence of a load in a direction of withdrawal of a tongue plate (not shown) through the latter during rapid reduction in speed of a vehicle, the tongue piece 306 is inserted into the through hole 302 to prevent the rotation of the lock plate and to maintain the engagement of the lock plate with the tongue plate.

It will be understood that this embodiment is applicable to the previous first and second embodiments.

What is claimed is:

1. A buckle apparatus for locking a tongue plate inserted therein, comprising:

a buckle body having an opening, and into which the tongue plate is inserted;

a lock plate disposed in said buckle body, and adapted to be engaged by said inserted tongue plate, and provided with an insertion portion, so that said insertion portion is passed through said opening from a direction substantially perpendicular to the direction of insertion and withdrawal of said tongue plate, so that when a load larger than a predetermined value is applied to said tongue plate in the direction of withdrawal of said tongue plate in a condition of said tongue plate in engagement with said lock plate, at least a portion of said lock plate is moved in the direction of withdrawal of said tongue plate; and an engagement means provided between said buckle body and said lock plate and adapted to be brought into a lockingly engaged state between an edge of said opening of said buckle body and said insertion portion of said lock plate by the movement of at least a portion of said lock plate, thereby inhibiting the movement of said lock plate in a direction of separation from said tongue plate.

2. A buckle apparatus according to claim 1, wherein said lock plate is constructed so that a portion thereof is moved by a deformation.

3. A buckle apparatus according to claim 1, wherein said engagement means comprises an edge of said opening in said buckle body, and a projection extending in the tongue plate withdrawal direction from a side of said portion of said insertion portion in the tongue plate withdrawal direction and adapted to be brought into engagement with said edge by the movement of said at least portion of said lock plate.

4. A buckle apparatus according to claim 1, wherein said engagement means comprises an opening provided in said insertion portion, and a tongue piece projecting from an edge of said opening in said buckle body toward the inside of said opening in said buckle body and adapted to be inserted into said opening in said insertion portion into engagement with said edge of said opening in said insertion portion by the movement of at least a portion of said lock plate.

5. A buckle apparatus according to claim 1, wherein said engagement means further comprises a recess provided in said buckle body and depressed in the tongue plate withdrawal direction, and an insertion portion provided in said at least portion of said lock plate and adapted to be inserted into said recess into engagement with said recess by the movement of at least a portion of said lock plate.

6. A buckle apparatus according to claim 1, wherein said engagement means comprises an edge of said opening in said buckle body, a projection extending in the tongue plate withdrawal direction from a side of said portion of said insertion portion in the tongue plate withdrawal direction and adapted to be brought into engagement with said edge by the movement of said at least portion of said lock plate, a recess provided in said buckle body and depressed in the tongue plate withdrawal direction, and an insertion portion provided in said at least portion of said lock plate and adapted to be inserted into said recess into engagement with said recesss by the movement of at least a portion of said lock plate.

7. A buckle apparatus according to claim 1, wherein said lock plate is arranged so that the whole thereof is moved in said tongue plate withdrawal direction when a load larger than a predetermined value is applied to said tongue plate in said tongue plate withdrawal direction.

8. A buckle apparatus according to claim 7, wherein said engagement means comprises an edge of said opening in said buckle body, and a projection extending in the tongue plate withdrawal direction from a side of said portion of said insertion portion in the tongue plate withdrawal direction and adapted to be brought into engagement with said edge by the movement of said lock plate.

9. A buckle apparatus according to claim 7, wherein said engagement means comprises an opening provided in said insertion portion, and a tongue piece projecting from an edge of said opening in said buckle body toward the inside of said opening in said buckle body and adapted to be inserted into said opening in said insertion portion into engagement with an edge of said opening in said insertion portion by the movement of said lock plate.

10. A buckle apparatus according to claim 7, further including a biasing means for constantly urging said lock plate in said tongue insertion direction, and wherein the movement of said lock plate is effected against a biasing force of said biasing means.

11. A buckle apparatus for locking a tongue plate inserted therein, comprising:

a buckle body provided with an opening, and into which said tongue plate is inserted;

a lock plate disposed in said buckle body and adapted to be brought into engagement with said inserted tongue plate by a swinging movement in a first direction, thereby locking said tongue plate, and provided with an insertion portion, so that said insertion portion is passed through said opening from a direction substantially perpendicular to the directions of insertion and withdrawal of said tongue plate, so that when a tensioning force larger than a predetermined value is applied to said tongue plate in the direction of withdrawal of said tongue plate in a condition of said tongue plate locked to said lock plate, said lock plate is deformed by said tensioning force such that at least a portion thereof is moved in the direction of withdrawal of the tongue plate; and an engagement means provided between said buckle body and said lock plate and adapted to be brought into a lockingly engaged state between an edge of said opening of said buckle body and said insertion portion of said lock plate by the movement of said lock plate, thereby inhibiting the swinging movement of said lock plate in a second direction opposite from said first direction to prevent the engagement of said lock plate with said tongue plate from being released.

12. A buckle apparatus according to claim 6, wherein said engagement means comprises a projection formed on said lock plate to extend in said tongue plate withdrawal direction and adapted to inserted through said opening in said buckle body in said locked condition and to be brought into engagement with an edge of said opening in said buckle body by said movement of said lock plate.

13. A buckle apparatus according to claim 11, wherein said engagement means comprises an opening provided in said portion of said lock plate, and a tongue piece formed on an edge of said opening in said buckle body and adapted to be inserted into said opening in said lock plate into engagement with an edge of said opening in said lock plate.

14. A buckle apparatus according to claim 11, wherein said engagement means further comprises a recess provided in said buckle body and depressed in the tongue plate withdrawal direction, and an insertion portion provided in said portion of said lock plate and adapted to be inserted into said recess into engagement with said recess by said movement of said lock plate.

15. A buckle apparatus for locking a tongue plate inserted therein, comprising:

a buckle body provided with an opening, and into which said tongue plate is inserted;

a lock plate disposed in said buckle body and adapted to be brought into engagement with said tongue plate by a movement in a first direction substantially perpendicular to a direction of insertion of said tongue plate, thereby locking said tongue plate, and provided with an insertion portion, so that said insertion portion is passed through said opening from a direction substantially perpendicular to the directions of insertion and withdrawal of said tongue plate, so that when a tensioning force larger than a predetermined value is applied to said tongue plate in the direction of withdrawal of said tongue plate in a condition of said tongue plate locked to said lock plate, said lock plate is slid on said buckle body by said tensioning force in the direction of withdrawal of said tongue plate; and an engagement means provided between said buckle body and said lock plate and adapted to be brought into a lockingly engaged state between an edge of said opening of said buckle body and said insertion portion of said lock plate by the movement of said lock plate, thereby inhibiting the movement of said the lock plate in a second direction opposite from said first direction to prevent the engagement of said lock plate with said tongue plate from being released.

16. A buckle apparatus according to claim 15, wherein said engagement means comprises a projection formed in said lock plate to extend in said tongue plate withdrawal direction and adapted to be inserted into said opening in said buckle body in said locked condition and to be brought into engagement with an edge of said opening in said buckle body by said movement of said lock plate.

17. A buckle apparatus according to claim 15, wherein said engagement means comprises an opening provided in said portion of said lock plate, and a tongue piece formed on an edge of said opening in said buckle body and adapted to be inserted into said opening in said lock plate into engagement with an edge of said opening in said lock plate by said movement of said lock plate.

18. A buckle apparatus for locking a tongue plate inserted therein, comprising:

a buckle body having an opening into which the tongue plate is inserted;

a lock plate disposed in said buckle body and having a first end adapted to be engaged by the inserted tongue plate, so that when a load larger than a predetermined value is applied to said tongue plate in a direction of withdrawal when said tongue plate is engaged to said lock plate, at least a portion of said lock plate will move in a direction of withdrawal of said tongue plate, said lock plate further having a second end pivotally connected to said buckle body at a point below said tongue plate receiving opening to generate a movement in said lock plate that forces said lock plate toward said tongue plate when said lock plate is moved in a direction of withdrawal; and an engagement means provided between said buckle body and the portion of the lock plate engaging the tongue plate body and adapted to be brought into a lockingly engaged state by the movement of at least a portion of said lock plate, thereby preventing said lock plate from moving in a direction of separation from said tongue plate.

* * * * *